United States Patent [19]

Raggio

[11] 4,067,350

[45] Jan. 10, 1978

[54] GAS LIFT VALVE

[76] Inventor: Ivan J. Raggio, 6154 Canal Blvd., New Orleans, La. 70124

[21] Appl. No.: 808,985

[22] Filed: June 22, 1977

Related U.S. Application Data

[63] Continuation of Ser. No. 688,061, May 19, 1976, abandoned, which is a continuation of Ser. No. 407,088, Oct. 17, 1973, abandoned, which is a continuation-in-part of Ser. No. 309,175, Nov. 24, 1972, abandoned.

[51] Int. Cl.[2] ..... F04F 1/08

[52] U.S. Cl. ..... 137/155; 417/116

[58] Field of Search ..... 137/155; 417/116

[56] References Cited

U.S. PATENT DOCUMENTS

| | | | |
|---|---|---|---|
| 2,556,867 | 6/1951 | Carlisle | 137/155 |
| 2,797,700 | 7/1957 | McGowen | 137/155 |
| 3,053,323 | 9/1962 | Wright | 137/155 X |
| 3,066,690 | 12/1962 | Tausch | 137/155 |

*Primary Examiner*—Alan Cohan

[57] ABSTRACT

A gas lift valve capable of being actuated by fluid such as a predetermined liquid head in a tubing string or by gas in a casing surrounding the tubing for introducing lifting gas from the casing into the tubing for lifting liquid in the tubing from one elevation to a higher elevation, wherein the valve has an adjustable resilient means which is adjustable for different pressure conditions from externally of the valve to thereby avoid extensive disassembly and reassembly for adjustment of the resilient means, and wherein the valve stem below the bellows is virtually eliminated whereby valve stem bowing and corkscrewing with resultant problems are overcome. The resilient means is disposed above the bellows and is isolated from well fluid so that it can operate in the absence of any fluid or pressure to thereby enable the use of various resilient materials having more desirable spring rate characteristics. Drag from the spring or resilient means is minimized and essentially eliminated.

1 Claim, 3 Drawing Figures

GAS LIFT VALVE

CROSS-REFERENCE TO RELATED APPLICATION

This application is a continuation of copending application Ser. No. 688,061, filed May 19, 1976, which is a continuation of application Ser. No. 407,088, filed Oct. 17, 1973, which is a continuation-in-part of U.S. Patent application, Ser. No. 309,175 filed Nov. 24, 1972 all of which are abandoned.

BACKGROUND OF THE INVENTION

The field of this invention is gas lift valves. Through the years, it has been accepted practice to make gas lift valves with a relatively long valve stem extending from a bellows to a valve seat, such as illustrated in U.S. Pat. Nos. 2,465,060; 3,194,175 and 3,424,099. In some instances, the spring for closing the valve has been located below the bellows as in said U.S. Pat. Nos. 2,465,060 and 3,194,175 and in other cases, the spring has been located above the bellows, but in all instances, so far as known, the valve stem has been long and has been subject to the undesirable characteristics of bowing and corkscrewing which results in dragging on the spring or improper seating of the valve, or both. Since the opening and closing of gas lift valves must be closely controlled for effective gas lifting operations, such deficiencies reduce effective gas lift operations and reduce the efficiency of operation, resulting in lower production of the oil from the well.

Also, so far as know, and as illustrated by the foregoing patents, the adjustment of the spring pressure has been difficult and time-consuming because the valves have had to be substantially disassembled to accomplish such adjustment, and sometimes the disassembly and reassembly must be repeated to get the proper adjustment. Since adjustments become necessary with changes in the use of the valves and well conditions, the necessity of disassembly and reassembly of the prior art valves for adjustment has been highly undesirable.

SUMMARY OF THE INVENTION

The present invention relates to a new and improved gas lift valve which has a short enough valve stem or virtually no valve stem at all below the bellows to eliminate bending of the stem and drag due the corkscrewing and/or bowing of the spring which occurred in the prior art valve stems. Further, the gas lift valve is capable of having its resilient means for urging the valve to a closed position adjusted without disassembly of the valve to thereby save the time and expense of the prior art disassembly and reassembly for spring adjustment purposes.

The valve spring is disposed so that there is no drag thereon and it is isolated from the well fluid and is preferably operated in a gas at atmospheric pressure for enabling springs or other resilient means having desirable spring rate characteristics to be used.

DESCRIPTION OF THE PREFERRED EMBODIMENT

Figure 1:
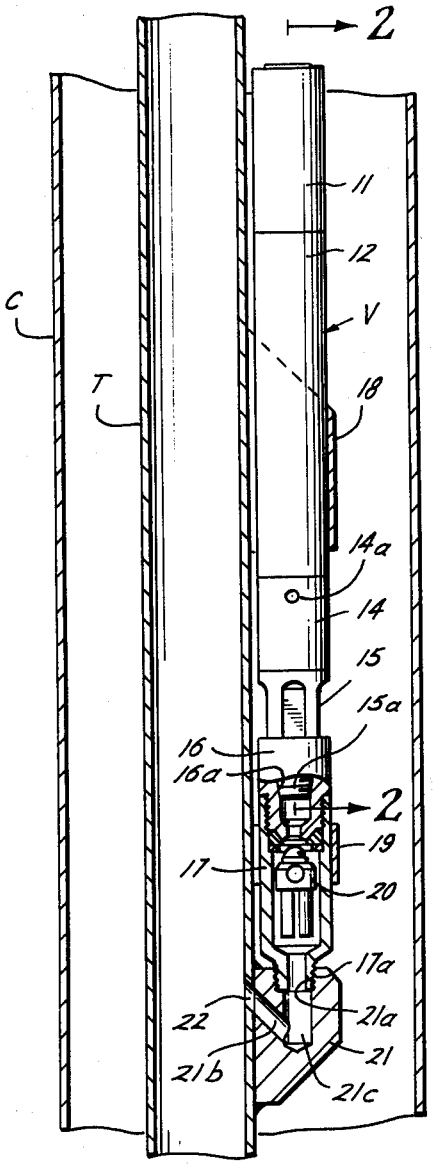
FIG. 1 is a vertical sectional view, partly in elevation, of one form of the gas lift valve of this invention mounted on a tubing string.

In the drawings, the letter V designates generally the gas lift valve of this invention which is illustrated as mounted externally of a tubing string T located in a well pipe or casing C. As will be explained in detail, the gas lift valve V is adapted to be actuated by a predetermined head of liquid in the tubing string T so as to admit gas from the casing C into the tubing string T for lifting the liquid such as oil to a higher elevation than that at which the valve V is located.

Figure 2:
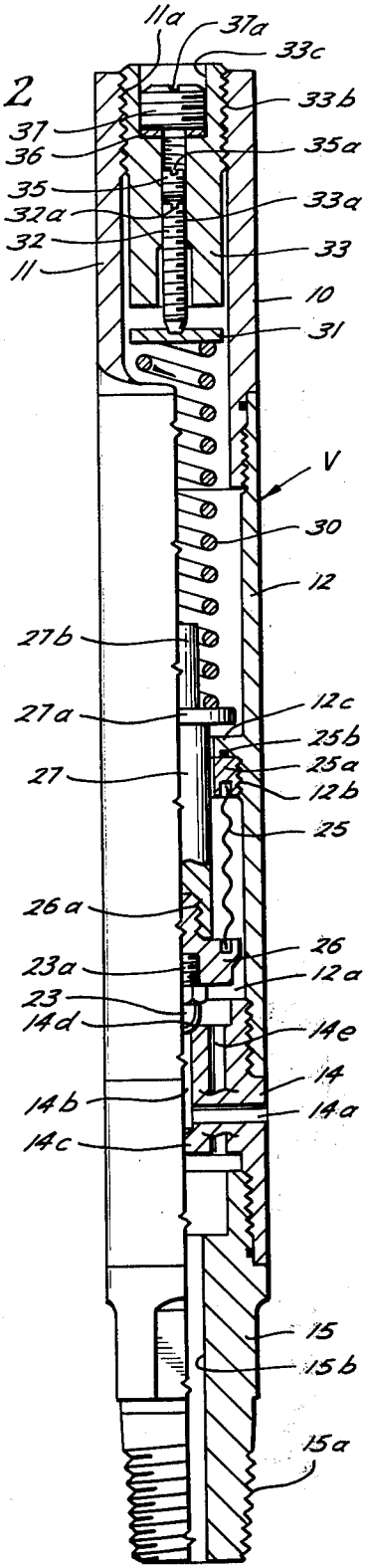
FIG. 2 is an enlarged detailed view, partly in section and partly in elevation, of the form of the gas lift valve shown in FIG. 1.

Considering the details of the gas lift valve V, such valve V includes a valve housing 10 which is shown as including a plurality of threaded components to form the valve housing with a desired configuration for manufacturing and assembly purposes. Thus, as illustrated in FIG. 2, the housing 10 includes an upper housing section 11, an intermediate housing section 12, a housing adapter section 14 and a lower mounting housing section 15. The lower housing section 15 preferably has threads **15*a* for threaded engagement in corresponding internal threads 16*a* in a check valve seat section 16 which is connected to a check valve housing 17 having a check valve 20 therein of conventional construction, an example of which is illustrated in U.S. Pat. No. 2,670,922. The check valve housing 17 has external threads 17*a* which are adapted to thread into internal threads 21*a* in a mandrel 21 of conventional construction which is welded or is otherwise secured to the external surface of the tubing string T adjacent a port 22 in the tubing string T which communicates with a lateral passage 21*b* and a longitudinal passage 21*c* which in turn are in communication with the bore of the check valve housing 17 and the bore 15*b* of the lower body section 15**.

The adapter section 14 has one or more ports **14*a* therein which communicate with the area externally of the gas lift valve V and thus establish communication between the gas in the casing C and the interior of a short passage 14*b* in the adapter section 14 which is closed at its lower end 14*c* and which open at its upper end, but is provided with a valve seat 14*d* for receiving a valve element 23** for closing same as will be explained.

The adapter section 14 also has a longitudinal passage or passages **14*e* which extend from the bore 15*b* upwardly through the adapter section 14, but without crossing or interconnecting with the lateral passage or passages 14*a* or the longitudinal passage 14*b*. The upper end of each opening 14*e* communicates with a chamber 12*a* which is defined by a wall of the intermediate housing section 12 and a bellows 25. The bellows 25 is formed of metal or any other suitable flexible material for providing a resilient sleeve that is capable of elongating and contracting to accommodate movements of the parts to which it is connected. The bellows 25 is connected at its upper end to a retaining ring 25*a* which is threaded into threads 12*b* formed internally of the intermediate housing section 12 or is otherwise connected by silver soldering or other suitable means. A suitable 0-ring or silver solder seal 25*b* provides a seal for the chamber 12*a* and prevents fluid from entering the area internally of the bellows 25**.

The valve element 23 is carried at the lower end of a bellows closure and support 26 to which the lower end of the bellows 25 is sealingly connected in any suitable manner. Preferably, the valve element 23 has a ball like shape and is provided with threads 23*a* for threading into a similarly threaded opening in the member 26. The member 26 is connected by any suitable means such as threads 26*a* to a longitudinal rod 27 which extends internally of the bellows 25, through the retainer ring 25*a* and also a stop shoulder 12*c* formed internally of the housing section 12.

The longitudinal rod 27 extends only a short distance above the upper end of the bellows 25 so that its length corresponds substantially to that of the length of the bellows 25 and it is relatively large in diameter. Such rod 27 has a washer 27*a* thereon which forms a shoulder, and a short guide stem 27*b* thereabove so that a spring 30 of other suitable resilient means such as a rubber resilient member, is disposed on the shoulder 27*a* and is confined against lateral displacement by the guide stem 37*b*.

The upper end of the spring 30 is engaged by a plate 31 which is movable in the upper housing section 11 and which is adjustable to adjust the compression of the spring 30 by means of a threaded adjusting screw 32 which is threaded into internal threads 33*a* in a closure or plug 33. The closure or plug 33 has external threads 33*b* which are threaded into corresponding internal threads 11*a* in the upper body section 11. Such threaded connection provides a seal to inhibit or prevent fluid from flowing into the area of the housing 10 defined by the plug 33 at one end and the bellows 25 at the lower end. Thus, the spring 30 is located in a sealed off area from well fluid and from all other liquid so that it is at atmospheric pressure under normal operating conditions which makes it possible to use a material for the spring 30 which has more desirable spring rate characteristics than when the spring must act under pressure or corrosive atmospheric conditions. The spring 30 is adjusted by the adjusting screw 32 so as to exert a predetermined force on the valve element 23 which must be overcome by the fluid pressure acting upwardly on the bellows 25 from the liquid in the tubing string T and also to some extent by the gas in the casing acting upwardly on the valve element 23. As will be explained, in some instances, the casing gas pressure may be utilized for opening or maintaining the valve element 23 open under certain conditions, but normally the gas lift valve V of this invention is a fluid actuated valve which is operated by the predetermined head of liquid in the tubing string T which operates to move the bellows 25 upwardly and overcome the spring pressure of the spring 30 to unseat the valve element 23.

A lock screw 35 is preferably threaded into the threads 33*a* of the plug 33 to position same above the adjusting screw 32 to prevent inadvertent unthreading of such screw 32 once the setting has been obtained for the spring 30. A water tight closure is also preferably provided above the lock screw 35 and the adjustment screw 32 by means of a gasket 36 formed of rubber, copper or other suitable sealing material which is held in place by a threaded plug 37 which is threaded into a threaded opening 33*c* or other suitable means at its upper end so that it can be adjusted by a screwdriver engaging same from externally of the housing 10 when the lock screw 35 and the plug 37 are removed. Similarly, the lock screw 35 has a screwdriver slot 35*a* in its upper end for engagement by a screwdriver for positioning it in abutment with the upper end of the lock-screw 32 as shown in FIG. 2 and for also releasing same when it is desired to have access to the adjusting screw 32. The threaded plug 37 also has a screwdriver slot 37*a* so that it can be inserted and removed with a screwdriver. Thus, only conventional tools are required for obtaining access to the adjusting screw 32 and such screw 32 is readily accessible from externally of the valve V so that the adjustment of the spring pressure 30 may be accomplished quickly and without any disassembly of the valve V itself.

In the operation or use of the gas lift valve V of this invention, it is initially mounted on a tubing string T, externally thereof by lowering same through support sleeves or segments 18 and 19 which are welded or are otherwise affixed to the external surface of the tubing string T. The threads 17*a* thread into the threads 21*a* of the mandrel 21 so as to form a fluid seal therewith, whereby the gas lift valve is supported on the tubing string T with communication being established with the interior of the tubing string T, as previously explained.

When the liquid in the tubing string T rises above the port 22 a predetermined distance so that a predetermined head is formed in the tubing string T sufficient to move the bellows 25 upwardly and unseat the valve element 23 from the seat 14*d*, then the gas in the casing C enters the chamber 12*a* through the passages 14*a* and 14*b* and it flows downwardly through the passage 14*e* and the bore 15*b* past the check valve 20 and through the mandrel passages 21*c* and 21*b*, and the port 22 into the interior of the tubing string T where it operates to lift the oil or other liquid thereabove to a higher elevation.

It will be understood that a single valve may be used or a series of gas lift valves V may be located at various elevations along the tubing T.

Because the apparatus of this invention has no valve stem below the bellows member 26, or such stem is so short that it has no tendency to bend due to corkscrewing or bowing of the spring or for any other reason, the dragging and improper seating heretofore experienced in prior constructions is eliminated with this invention. Additionally, as heretofore noted, the spring 30 operates in a chamber which is remote from the liquid in the well and other liquid and is at zero p.s.i.g. or low pressure, usually with air or nitrogen, so that its operation is more consistent than when operating under pressure conditions. Also, since the spring 30 is out of contact with any stem and only a short guide stem 27*b* is required to prevent lateral shifting of the spring 30, there is virtually no drag or resistance by the spring 30 itself as it compresses and extends during operations.

It is to be noted that the check valve 20 is of conventional construction and preferably operates without a spring as shown in FIG. 1, so that it floats in an open position under normal gas lift operations so as to permit fluid flow around the check valve 20 unless the pressure of the fluid flowing in the tubing string reaches a predetermined amount which is sufficient to move the valve 20 to the upper closed position. This would normally occur if there was ordinary flow in the tubing string T, but under normal gas lift operations, the valve 20 may either fall to the bottom of its housing 17 or float in substantially the position shown in FIG. 1. In any event, the check valve 20 does not interfere with the flow of the liquid from the tubing string T to the chamber 12*a*, nor with the flow of the gas from the chamber 12*a* into the tubing string T when the valve element 23 is moved to the open position.

Although the invention has been illustrated with a spring 30 which is normally formed of a metal such as brass or stainless steel, it should be noted that the spring 30 may be replaced by any other suitable resilient material such as a rubber sleeve or a coiled rubber spring. Since the resilient means 30 does not have to operate in a liquid or under pressure conditions and may operate at zero pounds per square inch gauge, it may have desirable spring rate characteristics which are not as easily obtainable under other conditions.

As explained in connection with the form of the invention shown in FIG. 3, gas pressure from the casing may be used for operating the valve. When casing gas pressure is used, the isolation of the spring 30 from such gas is even more important since the spring rate is more important in such operation.

Although the invention has been described as mounted conventionally in an external mandrel on the tubing, it will be understood that the valve V may also be of the retrievable type for use with side pocket mandrels in the tubing flow string in the known manner.

Figure 3:
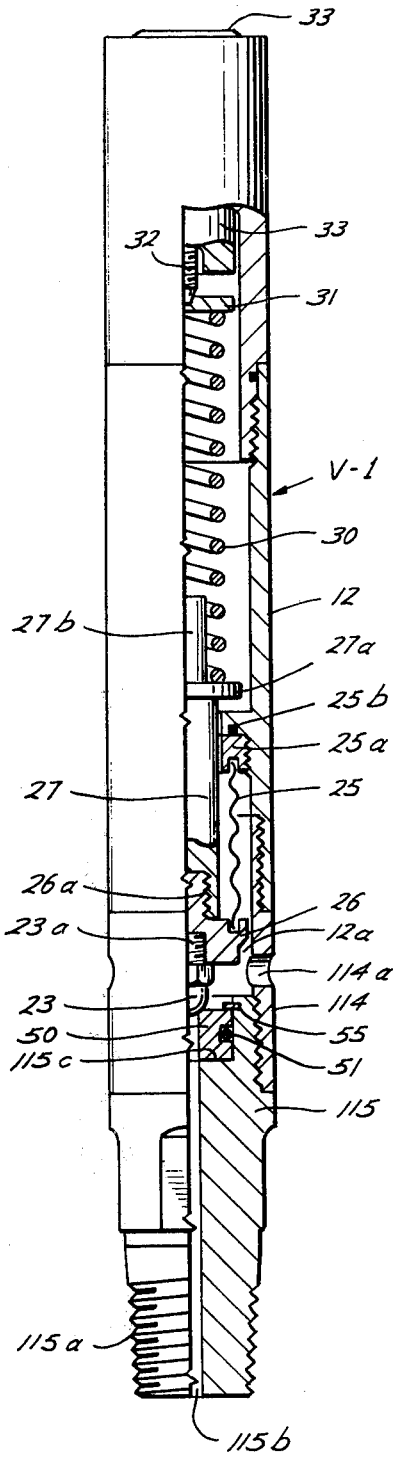
FIG. 3 is a view similar to FIG. 2, but showing a modified form of the gas lift valve of this invention which is actuated primarily by gas pressure from the casing.

A modified form of the gas lift valve of this invention, designated V-1 is illustrated in FIG. 3. The valve V-1 is particularly adapted to be actuated by the gas in the casing C, externally of the tubing T. The parts of the valve V-1 which are identical with, or substantially the same as, the parts of the valve V have been designated with the same numerals and/or letters in FIG. 3.

Essentially, the lower portion of the housing 10 has been modified so that the fluid chamber **12*a* is in normal communication with the casing gas in the casing C through a fluid passage 114*a* in a housing adapter 114 which is connected below the intermediate housing section 12. Also, the lower housing section 115 is preferably modified as compared to the lower housing section 15 so as to accommodate a removable annular valve seat 50 having an O-ring seal 51 therewith. The valve seat 50 is removably retained in a recess 115*c* by a snap-ring 55 or other suitable removable retaining means. The valve element or member 23 is adapted to engage the valve seat 50 to close off fluid flow through the fluid passage 115*b*. Thus, the valve seat 50 takes the place of the valve seat 14*d* in the valve V shown in FIG. 2. It should be understood that the valve seat 50 may be formed integrally with the housing section 115 in the same manner as the valve seat 14*d*, and likewise, the valve seat 14*d* may have a removable valve seat such as the valve seat 50 of FIG. 3**.

The lower threads **115*a* are adapted to be threaded into position with the check valve seat section 16 (FIG. 1) in the same manner as heretofore described in connection with the threaded engagement of the threads 15*a* with the check valve seat section 16. Thus, the valve V-1 is mounted externally of the tubing T in the same manner as illustrated in FIG. 1 so that the passage 115*b* is in fluid communication with the liquid within the tubing T, and therefore, the liquid is in communication with the valve element 23 when it is in the seated position closing the passage 115*b*. With such arrangement shown in FIG. 3, it can be seen that the area of the bellows 25 which is exposed to the casing gas through the passage 114*a* is much greater than the area of the valve element 23 which is exposed to the fluid in the passage 115*b***. In such form of the invention, therefore, the opening of the valve is controlled by the pressure of the gas in the casing C which may be regulated from the surface for thereby controlling the injection of gas into the tubing string T.

In the operation or use of the valve V-1, the valve V-1 is opened by increasing the pressure of the gas in the casing high enough to unseat the valve element 23 from its valve seat 50, thereby establishing fluid flow through the fluid chamber **12*a* and between the passages 114*a* and 115*b*, to thereby admit gas from the casing C into the tubing T for lifting the liquid head which is above the inlet opening 22** in the tubing T.

It should be noted that the term "fluid" as used herein and in the claims refers to either a liquid or a gas, or both together.

The foregoing disclosure and description of the invention are illustrative and explanatory thereof, and various changes in the size, shape, and materials as well as in the details of the illustrated construction may be made without departing from the spirit of the invention.

I claim:

1. A gas lift valve capable of being actuated by fluid in a tubing string including:

a valve housing including means for supporting said housing with the tubing;

a valve seat mounted within said housing;

a valve element being positioned in two positions, said first position being on said valve seat and said second position being away from said valve seat;

a bellows section positioned above said valve seat including a bellows chamber area;

a bellows closure member mounted with said valve element and positioned in said bellows chamber area;

a flexible bellows mounted with said bellows closure member and extending upwardly in said bellows chamber area;

a sealing member mounted with said valve housing for suitably sealing the upper end of said bellows thereto;

a longitudinal rod positioned internally with said bellows and mounted with said bellows closure member and extending upwardly through said sealing member;

a shoulder member mounted with said rod immediately adjacent and outside of said bellows chamber area;

resilient means being received by said shoulder and extending upwardly therefrom;

a short guide stem extending upwardly from said shoulder to thereby eliminate a long valve stem which eliminates cork screwing or bowing of the spring and improper dragging and seating of the valve element;

an adjustable threaded sealing section receiving the other end of said resilient means for adjusting the urging force of said resilient means, the resilient means being located in an area sealed off from well fluids for using atmospheric pressure within said bellows during normal operating conditions and enabling the use of materials in said resilient means which provide more desirable spring rate characteristics than those usable under high pressure and corrosive atmospheric conditions;

at least one lateral port positioned below the valve seat;

a first longitudinal passage relative to said housing communicating with said lateral port at one end and said valve seat at the other end to permit fluid and gas communication from outside the tubing into said first longitudinal passage; and a second longitudinal passage relative to said housing extending from the interior of the tubing string to said bellows chamber area while being prevented from communication with said lateral port and said first longitudinal passage when the valve element is seated and permitting communication by unseating the valve element with fluid flowing from within the interior of the tubing string through the second longitudinal passage into the bellows chamber area for acting upon the bellows which thereby permits gas and fluid on the exterior of the tubing string to move upwardly through the first longitudinal passage and down the second longitudinal passage into the interior of the tubing string to lift the liquids therein to a higher elevation.

* * * * *